US010446071B2

(12) United States Patent
Lee et al.

(10) Patent No.: US 10,446,071 B2
(45) Date of Patent: Oct. 15, 2019

(54) DEVICE AND METHOD OF USING SLICE UPDATE MAP

(71) Applicant: SAMSUNG ELECTRONICS CO., LTD., Suwon-si (KR)

(72) Inventors: Sang-Hoon Lee, Seoul (KR); Jong-Ho Roh, Yongin-si (KR); Sang-Hoon Ha, Seoul (KR); Sung-Hoo Choi, Hwaseong-si (KR); Hoon-Mo Yang, Hwaseong-si (KR); Seong-Woon Kim, Suwon-si (KR); Jong-Hyup Lee, Seoul (KR); Ha-Na Yang, Gunpo-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 70 days.

(21) Appl. No.: 15/473,071

(22) Filed: Mar. 29, 2017

(65) Prior Publication Data

US 2017/0287384 A1 Oct. 5, 2017

Related U.S. Application Data

(60) Provisional application No. 62/315,939, filed on Mar. 31, 2016.

(30) Foreign Application Priority Data

Jan. 9, 2017 (KR) ..... 10-2017-0003051

(51) Int. Cl.

| | |
|---|---|
| ***G09G 5/36*** | (2006.01) |
| ***G09G 3/20*** | (2006.01) |
| ***G09G 5/02*** | (2006.01) |
| ***G09G 5/22*** | (2006.01) |
| ***G09G 5/395*** | (2006.01) |

(52) U.S. Cl.

CPC ..... *G09G 3/20* (2013.01); *G09G 5/026* (2013.01); *G09G 5/225* (2013.01); *G09G 5/363* (2013.01); *G09G 5/395* (2013.01); *G09G 2330/021* (2013.01); *G09G 2340/0464* (2013.01); *G09G 2340/14* (2013.01)

(58) Field of Classification Search

CPC ..... G09G 5/393; G09G 2320/103; G09G 2340/0464; G09G 5/395; H04N 19/174; H04N 19/176

See application file for complete search history.

(56) References Cited

U.S. PATENT DOCUMENTS

| | | | | |
|---|---|---|---|---|
| 7,053,902 | B1 | 5/2006 | Kurose | |
| 8,675,020 | B2 | 3/2014 | Lim | |
| 8,872,836 | B2 | 10/2014 | Rabii | |
| 8,958,642 | B2 | 2/2015 | Cho et al. | |
| 2013/0003830 | A1 | 1/2013 | Misra et al. | |
| 2014/0267329 | A1* | 9/2014 | Lee | G06T 1/20 345/522 |
| 2014/0362098 | A1 | 12/2014 | Kerofsky | |

(Continued)

*Primary Examiner* — Hau H Nguyen

(74) *Attorney, Agent, or Firm* — F. Chau & Associates, LLC

(57) ABSTRACT

An electronic device includes a processor configured to generate a slice update map indicating a location of at least one updated slice having a data change in frame data including a plurality of slices; and a display controller configured to extract frame data of the at least one updated slice from a memory based on the slice update map and transfer the frame data to a display driver.

17 Claims, 16 Drawing Sheets

(56) References Cited

U.S. PATENT DOCUMENTS

| | | | | |
|---|---|---|---|---|
| 2015/0172714 | A1 | 6/2015 | Wu et al. | |
| 2016/0014421 | A1 | 1/2016 | Cote et al. | |
| 2016/0180796 | A1* | 6/2016 | Morein | G06T 11/60 345/629 |
| 2017/0105023 | A1* | 4/2017 | Marchya | H04N 19/55 |

* cited by examiner

FIG. 12B 1220 1222

| | | | |
|---|---|---|---|
| 0 | 1 | 2 | 3 |
| 4 | 5 | 6 | 7 |
| 8 | 9 | 10 | 11 |
| 12 | 13 | 14 | 15 |
| 16 | 17 | 18 | 19 |
| 20 | 21 | 22 | 23 |
| 24 | 25 | 26 | 27 |
| 28 | 29 | 30 | 31 |
| 32 | 33 | 34 | 35 |
| 36 | 37 | 38 | 39 |
| 40 | 41 | 42 | 43 |
| 44 | 45 | 46 | 47 |
| 48 | 49 | 50 | 51 |
| 52 | 53 | 54 | 55 |
| 56 | 57 | 58 | 59 |
| 60 | 61 | 62 | 63 |
| 64 | 65 | 66 | 67 |

UPDATED SLICE

DEVICE AND METHOD OF USING SLICE UPDATE MAP

CROSS-REFERENCE TO RELATED APPLICATION

This application claims the benefit of U.S. Patent Application No. 62/315,939, filed on Mar. 31, 2016, in the U.S. Patent and Trademark Office, and priority to Korean Patent Application No. 10-2017-0003051, filed on Jan. 9, 2017, in the Korean Intellectual Property Office, the disclosures of which are incorporated by reference in their entireties herein.

BACKGROUND

1. Technical Field

The inventive concept relates to an electronic device, an electronic device control method, a display driving device, and a display driving method.

2. Discussion of Related Art

A display driver that drives a display panel receives display data from an external device or a processor and displays the display data on the display panel. The display driver receives updated display data every time images displayed on the display panel change and updates the images displayed on the display panel using the updated display data. For example, the display driver may update the images of the display panel at a predetermined frame rate. However, excessive power may be consumed when the display panel is updated using the updated display data. Accordingly, electronic devices and display panels that support high resolution images such as ultra high definition (UHD) may consume a large amount of power when they perform an update.

SUMMARY

At least one embodiment of the inventive concept provides a reduction in power consumption by reducing the size of a data stream for updating display data.

According to an exemplary embodiment of the inventive concept, there is provided an electronic device including a processor configured to generate a slice update map indicating a location of at least one updated slice having a data change in frame data including a plurality of slices; and a display controller configured to extract frame data of the at least one updated slice from a memory based on the slice update map and transfer the frame data to a display driver.

According to an exemplary embodiment of the inventive concept, there is provided an electronic device control method including generating a slice update map indicating a location of at least one updated slice having a data change in frame data including a plurality of slices; extracting frame data of the at least one updated slice from a memory based on the slice update map; and transferring the frame data to a display driver.

According to an exemplary embodiment of the inventive concept, there is provided a display driving device including a receiver configured to receive a serial transmission signal including a first location of a start point of a sub block having a data change, a second location of an end point of the sub block, and display data having a size of the sub block; a frame memory; and a processor configured to output a current frame stored in the frame memory to a display panel. The receiver is configured to update the current frame stored in the frame memory with the display data using the first location and the second location.

According to an exemplary embodiment of the inventive concept, there is provided a display driving method including: receiving a serial transmission signal including a first location of a start point of a sub block having a data change, a second location of an end point of the sub block, and display data having a size of the sub block; updating a current frame stored in a frame memory with the display data using the first location and the second location; and outputting the current frame to a display panel.

According to an exemplary embodiment of the inventive concept, there is provided a display driving device including: a frame memory configured to store a frame of display data; a display controller; a processor configured to divide the frame into a plurality of slices, determine which of the slices is to change, generate a map indicating only the slices that are to change, and output the map to the display controller; and a display driver configured to output the frame to a display panel. The display controller only fetches part of the frame using the map, performs an operation on the part to generate processed data, and updates the part with the processed data.

BRIEF DESCRIPTION OF THE DRAWINGS

Embodiments of the inventive concept will be more clearly understood from the following detailed description taken in conjunction with the accompanying drawings in which:

FIGS. 12A and 12B are diagrams for describing a scheme of defining sub blocks according to an exemplary embodiment of the inventive concept;

DETAILED DESCRIPTION OF THE EXEMPLARY EMBODIMENTS

The inventive concept will now be described more fully with reference to the accompanying drawings, in which embodiments of the inventive concept are shown.

Figure 1:
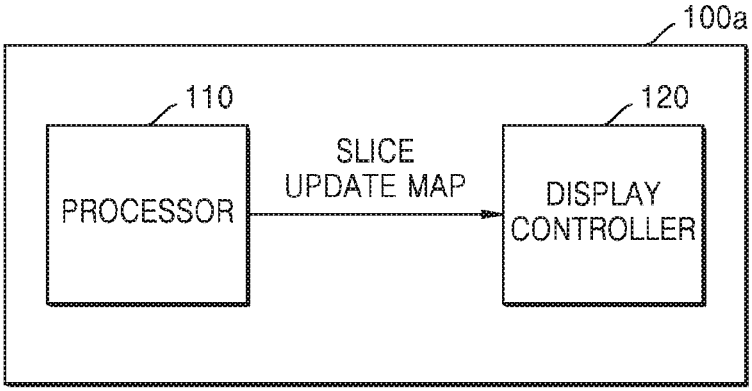
FIG. 1 is a block diagram of a structure of an electronic device according to an exemplary embodiment of the inventive concept.

FIG. 1 is a block diagram of a structure of an electronic device 100*a* according to an exemplary embodiment of the inventive concept.

The electronic device 100*a* according to the embodiment includes a processor 110 (e.g., microprocessor, a central processing unit, graphics processing unit) and a display controller 120 (e.g., a control circuit).

The electronic device 100*a* may be a device including at least one processor, including a display panel, or connected to a display device. The electronic device 100*a* may be implemented in various forms, for example, a laptop computer, a smart phone, a wearable device, a tablet computer, a portable terminal, a desktop computer, etc.

The processor 110 may control general operations of the electronic device 100*a*. In an embodiment, the processor 110 transfers a control signal to each of the components of the electronic device 100*a* to control the components of the electronic device 100*a*. For example, the processor 110 may be connected to the display controller 120 via a data bus and transfer the control signal to the display controller 120 using the data bus. Also, the processor 110 may execute an operating system (OS) or an application to perform and control various functions of the electronic device 100*a*.

The processor 110 may be implemented as processors of various forms such as a central processing unit (CPU), a host CPU, a microprocessor, an application processor (AP), or as a combination of these. Also, the processor 110 may be implemented as a combination of one or more processors.

The processor 110 according to an embodiment of the inventive concept generates frame data and then a slice update map indicating a position of an updated slice having a data change in the frame data. The updated slice refers to a slice having a data change in a one more pixels according to a frame change. The frame data may be generated at a predetermined frame rate or when a screen is changed according to embodiments of the inventive concept. The frame data according to an embodiment includes a plurality of slices. Different from previous frame data, the slice update map indicates a position of at least one updated slice having a data change. The plurality of slices may be defined by splitting an image frame region into rectangles of the same size. For example, each slice may be a different row of the image frame region, where each row corresponds to one or more rows of pixels. For example, if the image frame region is divided into a ten slices, and the third and fifth slice have a data change, the slice update map could include values of three and five.

The slice update map may be, for example, in a sequentially enumerated format of positions of updated slices. For example, the slice update map may have bit streams such as '1101, 1101, 1101, 0101, 0101, 0101 . . . ' For the case of UHD (3840*2160), 560 bits may be required for the slice update map. The slice update map may include a sequence of slice positions that are to be updated.

The display controller 120 may generate display data for output to a display driver that controls the display panel.

The display controller 120 according to an embodiment of the inventive concept receives the slice update map from the processor 110 and extracts the frame data of the updated slice from a memory based on the slice update map. That is, the display controller 120 does not fetch frame data of all pixels with respect to a frame from the memory but fetches only the frame data of the updated slice(s). According to an exemplary embodiment, the display controller 120 extracts only the frame data of the updated slice from the memory, which reduces the size of a data stream exchanged between the memory and the display controller 120, and thus power consumption may be reduced. According to an embodiment, the display controller 120 also fetches frame data of peripherals of the updated slice from the memory for image processing.

According to an embodiment, the display controller 120 fetches frame data in slice-based units from the memory. That is, the display controller 120 may operate by fetching and processing frame data of an updated slice from the memory and processing frame data of a next updated slice. The display controller 120 may process updated slices with respect to all frames until processing on the updated slices has completed.

Also, the display controller 120 may transfer the frame data of the updated slice to the display driver. According to an embodiment, the display controller 120 performs a predetermined image processing operation on the updated slice to generated processed data, compresses the processed data using a predetermined compression method to generate compressed display data, and transfers the compressed display data to the display driver. Also, the display controller 120 may transfer information about the updated slice to the display driver. For example, the display controller 120 may transfer information about a width, a height, and a size of the updated slice and updated display data to the display driver.

Figure 2:
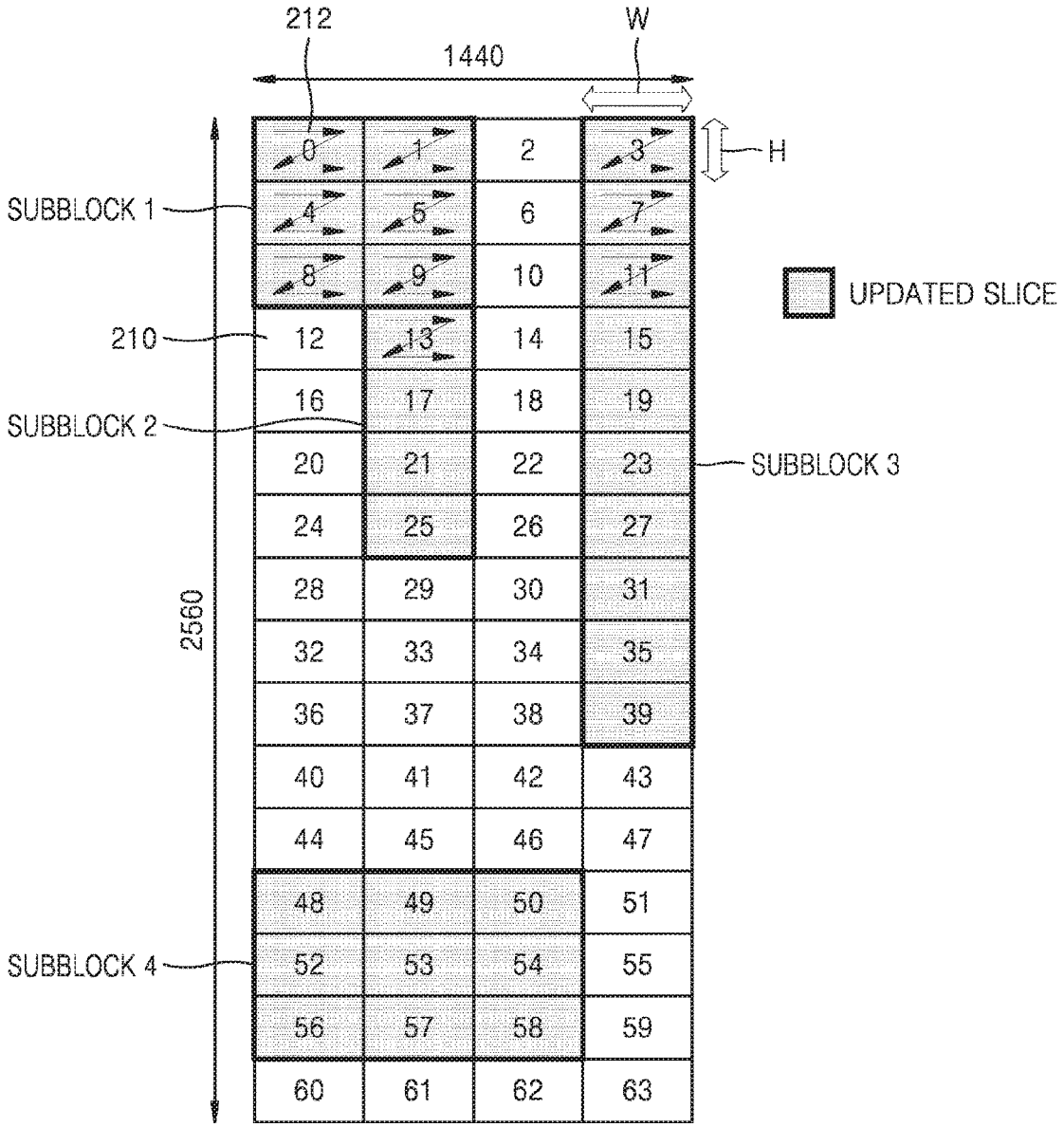
FIG. 2 illustrates frame data according to an exemplary embodiment of the inventive concept.

FIG. 2 illustrates frame data according to an exemplary embodiment of the inventive concept.

According to the embodiment, the frame data is split into a plurality of slices of the same size, as shown in FIG. 2. Each slice has a predetermined width W and a height H. For example, frame data having resolution of 1440*2560 may be split into slices of resolution of 360*160. In this case, the width W and the height H of each slice is respectively defined as 360 and 160. The non-updated slices 210 are not shaded and the updated slices 212 are shaded.

According to an embodiment, the display controller 120 groups updated slices into sub blocks and transfers display data in sub-block-based units to a display driver. For example, as shown in FIG. 2, when only data of some slices is changed according to a frame change, the display controller 120 groups updated slices into a sub block 1 SUBBLOCK 1 including slices 0, 1, 4, 5, 8, and 9, a sub block 2 SUBBLOCK 2 including slices 13, 17, 21, and 25, a sub block 3 SUBBLOCK 3 including slices 3, 7, 11, 15, 19, 23, 27, 31, 35, and 39, and a sub block 4 SUBBLOCK 4 including slices 48, 49, 50, 52, 53, 54, 56, 57, and 58. Each of the sub blocks 1 through 4 SUBBLOCK 1, 2, 3, and 4 may be defined to have a rectangular shape.

When the display controller 120 transfers the display data in a sub block-based unit, the display controller 120 may transfer the display data as well as information about the sub block to the display driver. According to an embodiment, the information about the sub block includes positions of start and end points of the sub block. For example, the information may include a first number (e.g., a starting index) that indicates a starting slice and a second number that indicates an ending slice when the slices of the sub block are in sequential order. For example, the information may include a first number that indicates an upper left corner slice, and a second number that indicates a lower right corner slice when the slices are arranged in two or more columns. According to an embodiment, the information about the sub block includes a width, a height, and the position of the start point of the sub block. The positions of the start and end points may be presented as, for example, coordinates of a pixel.

According to an embodiment, the display controller 120 transfers the information about the sub block and the display data in a sub block-based unit by serial transmission. For example, the display controller 120 may transfer the information about the sub block and the display data to the display driver by serial transmission according to the mobile industry processor interface (MIPI) alliance standard. In an embodiment, the display controller 120 compresses display data of each sub block according to the display stream compression (DSC) standard to generate compressed display data and transfers the compressed display data to the display driver.

According to an embodiment, data of each sub block is arranged, compressed, and transferred at a raster scan order. Also, according to an embodiment, the data of each sub block is arranged, compressed, and transferred in slice-based units. For example, when the data is transferred in slice-based units, and a sub block includes four slices, then a first slice would be transferred at time 1, followed by a second slice at time 2, etc.

According to an embodiment, the display controller 120 transfers the display data in slice-based units. With respect to at least one updated slice, the display controller 120 may transfer information about the updated slice and the display data in a slice-based unit to the display driver. According to an embodiment, the information about the updated slice includes a slice width, a slice height, and a slice update map.

The display controller 120 may transfer the display data at a raster scan order in a frame. Also, the display controller 120 may transfer the display data to the display driver in sub block based order or in slice-based order so as to support multiple partial windows in a display command set (DSC) encoded stream and comply with MIPI display command set (DCS) standards. However, a data stream transfer scheme from the display controller 120 to the display driver is not limited to DSC compression and various types of compression engines may be used when data is compressed in a sub block-based unit or in a slice-based unit.

Figure 3:
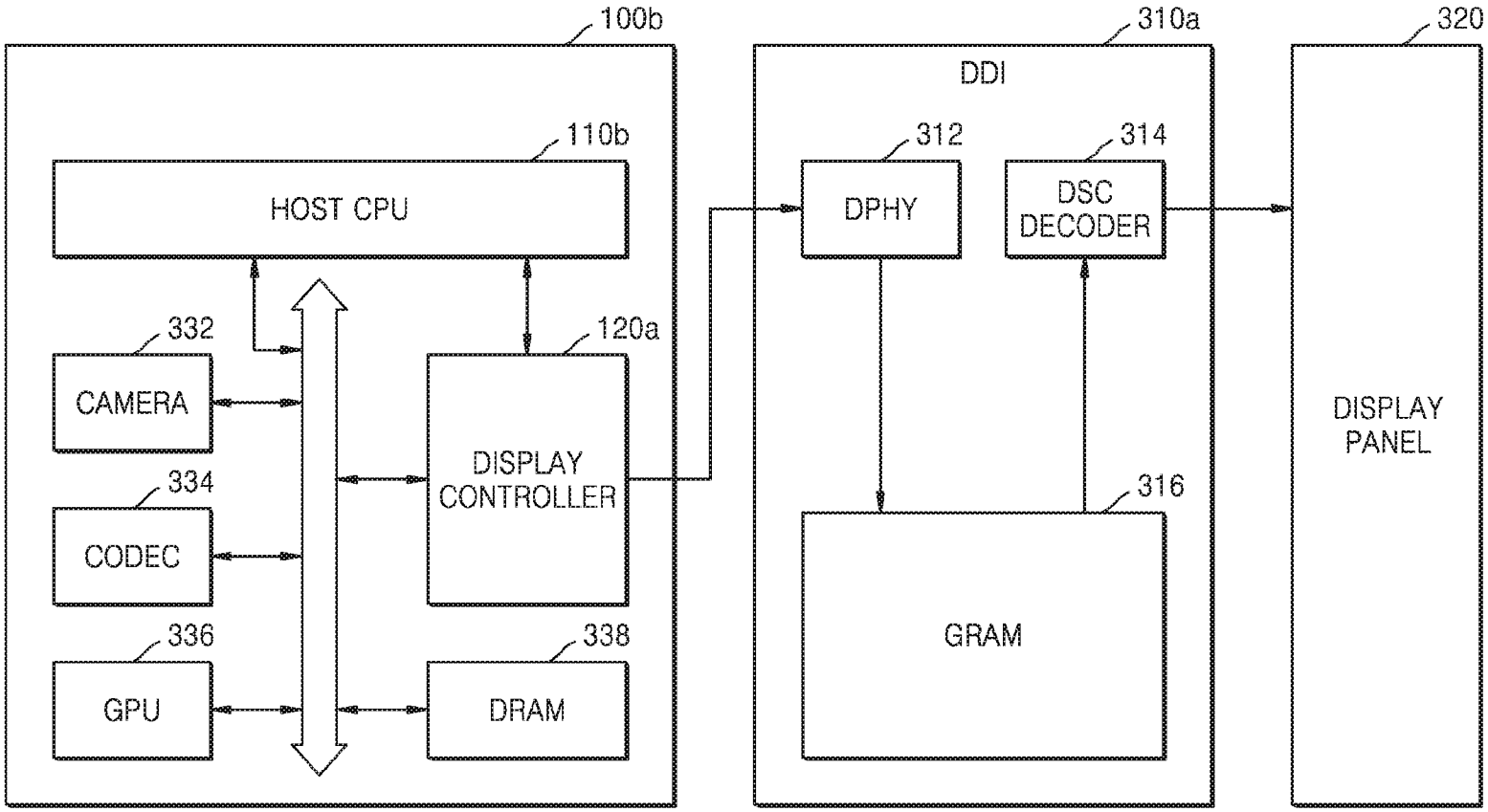
FIG. 3 is a block diagram of an electronic device, a display driver, and a display panel according to an exemplary embodiment of the inventive concept.

FIG. 3 is a block diagram of a display system including an electronic device 100*b*, a display driver 310*a*, and a display panel 320 according to an exemplary embodiment of the inventive concept.

According to the embodiment, the electronic device 100*b* generates display data and transfers the generated display data to the display driver 310*a*. The display driver 310*a* transfers the display data to the display panel 320. The electronic device 100*b*, the display driver 310*a*, and the display panel 320 may be provided in a package or separate packages. For example, the electronic device 100*b*, the display driver 310*a*, and the display panel 320 may be formed together on a single integrated circuit, or individually on separate integrated circuits.

The electronic device 100*b* includes a host CPU 110*b*, a camera 332, a codec 334, a graphics processing unit (GPU) 336, a display controller 120*a* (e.g., control circuit), and dynamic random access memory (DRAM) 338. The host CPU 110*b* may correspond to the processor 110 of FIG. 1.

The host CPU 110*b* may control general operations of the electronic device 100*b*. The host CPU 110*b* may execute various programs such as an OS or an application to control various functions of the electronic device 100*b*. The electronic device 100*b* may execute a program code stored in a storage medium to execute and control various functions. For example, the electronic device 100*b* may read a program code stored in a non-volatile storage medium (not shown) through the DRAM 338 to execute a program. According to an embodiment, the host CPU 110*b* operates in a control mode in which a program or a function is executed and a video mode in which image content including a still image or a moving image is reproduced.

The host CPU 110*b* performs a photographing function by using the camera 332. Also, the host CPU 110*b* may decode and reproduce an image content file by using the codec 334 or encode a photographing image to generate an image content file. As described above, the host CPU 110*b* may control various hardware units (devices) and software units (modules) included in the electronic device 100*b* to perform various functions. The codec 334 may be a device or a computer program for encoding or decoding data.

The host CPU 100*b* may generate a graphical user interface (GUI) screen while executing a program and output the generated GUI screen through the display panel 320. The host CPU 110*b* may output the GUI screen as frame data in the control mode and store the frame data in the DRAM 338.

Also, the host CPU 110*b* may reproduce image content by using the GPU 336. The host CPU 110*b* or the GPU 336 may generate a reproduction screen and store the reproduction screen as frame data in the DRAM 338.

The host CPU 110*b* may generate a slice update map while generating the frame data and output the slice update map to the display controller 120*a*. In an embodiment, the host CPU 110*b* outputs information about a width and a height of a slice to the display controller 120*a*.

The display controller 120*a* may use the slice update map to extract updated frame data from the DRAM 338. For example, when data of $1^{st}$, $2^{nd}$, $4^{th}$ and $5^{th}$ slices is changed among frame data including $0^{th}$ through $19^{th}$ slices, the display controller 120*a* fetches frame data corresponding to the $1^{st}$, $2^{nd}$, $4^{th}$, and $5^{th}$ slices from the DRAM 338 based on the slice update map.

In at least one embodiment of the inventive concept, in comparison to a case where all the frame data is fetched from the DRAM 338 every time one or more frames are changed, the size of a data stream transferred from the DRAM 338 to the display controller 120*a* is dramatically reduced, and thus power consumption may be reduced. In an embodiment, the GUI screen displays certain information in a predetermined template and is partially changed according to an operation of a program. Thus, power consumed by updating frames of the GUI screen may be dramatically reduced by using the slice update map.

Also, according to at least one embodiment of the inventive concept, intervention of software executed by the host CPU 110*b* may not be needed during frame processing. In an embodiment, after a frame starts, hardware (i.e., the display driver 310*a*) automatically calculates information of a next slice and processes of each next slice until the frame has completed.

The display driver 310*a* may receive, store, and decode the display data from the electronic device 100*b* and output the display data to the display panel 320. The display driver 310*a* may be implemented in a device driver interface (DDI) form.

The display driver 310*a* according to an embodiment includes a DPHY 312, graphic RAM (GRAM) 316, and a display stream compression (DSC) decoder 314. In an embodiment, the DPHY 312 is implemented by a processor.

The DPHY 312 receives the display data from the electronic device 100*b*. The display controller 120*a* of the electronic device 100*b* may compress information about an updated sub block or the updated slice and the display data according to the MIPI DCS standards and transmit the compressed information and the compressed display data to the DPHY 312 of the display driver 310*a*. The DPHY 312 may receive and store a data stream in the GRAM 316 according to the MIPI DCS standards. The GRAM 316 may store the display data in frame-based units. The GRAM 316 may store the display data in DSC compression form. In an embodiment, the DSC decoder 314 reads the DSC compressed display data from the GRAM 316 at predetermined timing, decodes the read DSC compressed display data to generate decoded display data, and transfers the decoded display data to the display panel 320.

The display panel 320 displays the display data output from the display driver 310*a*. The display panel 320 may be updated in a raster scan order. The display panel 320 may be implemented as, for example, a liquid crystal display (LCD) panel, an organic light-emitting diode (OLED) panel, or an electrophoresis display panel.

Figure 4:
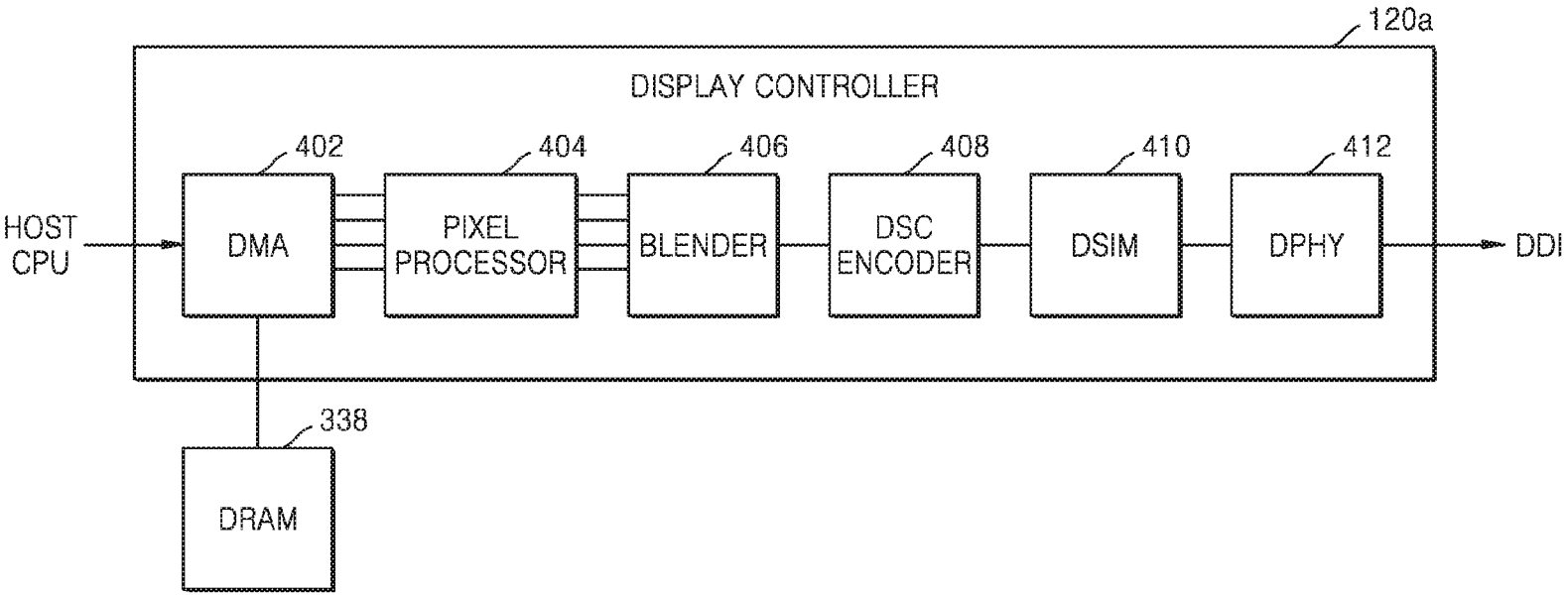
FIG. 4 is a block diagram of a display controller and dynamic random access memory (DRAM) according to an exemplary embodiment of the inventive concept.

FIG. 4 is a block diagram of the display controller 120*a* and the DRAM 338 according to an exemplary embodiment of the inventive concept.

The display controller 120*a* according to the embodiment includes a direct memory access (DMA) controller 402, a pixel processor 404, a blender 406, a DSC encoder 408, a display serial interface master (DSIM) 410, and a DPHY 412.

The DMA controller 402 receives a slice update map from the host CPU 110*b* and receives frame data of an updated slice from the DRAM 338 based on the slice update map. In an embodiment, the DMA controller 402 determines an access address and a number of transfer pixels with respect to the DRAM 338 based on the slice update map. The access address may indicate a location within the DRAM 338 and the number of transfer pixels may indicate an amount of data to retrieve from the location for a certain number of pixels of the display panel.

Figure 5:
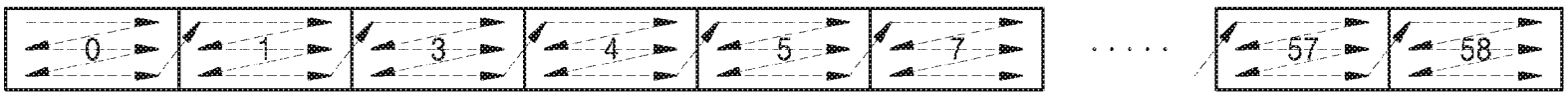
FIG. 5 illustrates the order in which a direct memory access (DMA) reads frame data from DRAM according to an exemplary embodiment of the inventive concept.

FIG. 5 illustrates the order in which the DMA 402 reads frame data from the DRAM 338 according to an embodiment of the inventive concept.

The DMA controller 402 may, for example, fetch pixel data in slice-based units from the DRAM 338 and access the DRAM 338 in order to fetch the pixel data in a raster scan order with respect to each slice as shown in FIG. 5. The DMA controller 402 may transfer the frame data of an updated slice to the pixel processor 404.

Referring to FIG. 4, the pixel processor 404 may perform at least one of color coordinate conversion processing and image enhancement processing on the frame data. For example, the pixel processor 404 may convert the frame data from YUV color coordinates to RGB color coordinates. Also, the pixel processor 404 may adjust at least one of brightness, color, and contrast of the frame data to perform image enhancement processing on the frame data.

The blender 406 may blend the frame data on which color coordinate conversion processing and image enhancement processing are performed by the pixel processor 404. For example, the blender 406 may be implemented by a processor.

In an embodiment, the DSC encoder 408 encodes the frame data output from the blender 406 according to DSC standards. Although an embodiment in which the frame data is encoded according to the DSC standards in FIG. 4 is described, in addition to the DSC standards, various encoding schemes may be used to encode the frame data.

According to an embodiment, the display controller 120*a* compresses the frame data of the updated slice in a sub block-based unit and transfers the compressed frame data to the display driver 310*a*. In an embodiment, the DSC encoder 408 groups at least one updated slice into a sub block-based unit and encodes the frame data updated in the sub block-based unit according to the DSC standards.

According to an exemplary embodiment, the display controller 120*a* compresses the frame data of the updated slice into a slice-based unit and transfers the frame data to the display driver 310*a*. In an embodiment, the DSC encoder 408 encodes the updated frame data in the slice-based unit according to the DSC standards.

The DSIM 410 may generate a data stream to be transferred to the display driver 310*a* by using the frame data output from the DSC encoder 408. According to an embodiment, the DSIM 410 generates the data stream in MIPI DSC form. For example, the DSIM 410 may output information about a sub block or a slice and the display data in a sub block-based unit or a slice-based unit to the DPHY 412. The DSIM 140 may be implemented by a processor.

The DPHY 412 may transfer the information about the sub block or the slice and the display data received from the DSIM 410 to the display driver 310*a*. According to an embodiment, the DPHY 412 transfers the MIPI DSC data stream to the display driver 310*a* by serial transmission.

A layer-type communication structure (hereinafter, referred to as a protocol stack) used in serial communication may be configured as a plurality of layers including a physical layer as a lowermost layer. Examples of the physical layer may include M-PHY, unified protocol (UniPro), PCI express, ultra high speed universal serial bus (USB), HyperTransport, RapidIO, InfiniBand, serial ATA, etc. In particular, M-PHY and UniPro have a low power consumption characteristic for supporting use in a mobile electronic device and are standardized in the MIPI alliance. Also, M-PHY (hereinafter referred to as MIPI M-PHY) and UniPro may be employed in the universal flash storage (UFS) interface standardized in the (Joint Electron Device Engineering Council) JEDEC.

Figure 6:
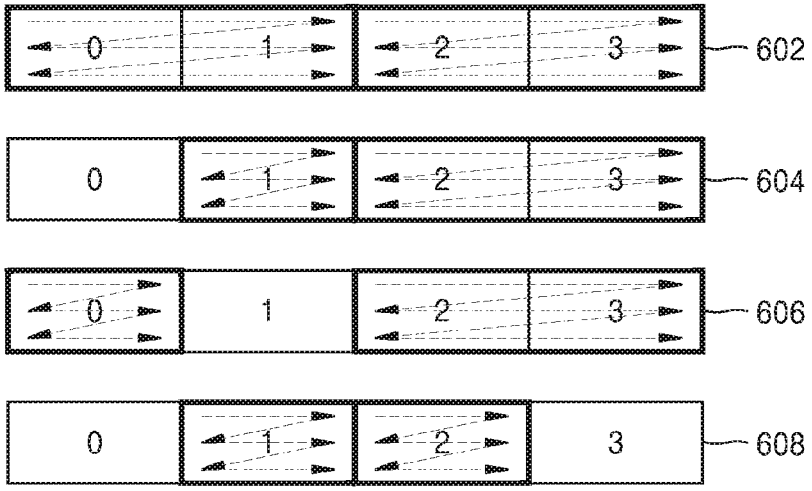
FIG. 6 illustrates data streams transferred from an electronic device to a display controller according to an exemplary embodiment of the inventive concept.

FIG. 6 illustrates data streams 602, 604, 606, and 608 transferred from the electronic device 100*b* to the display controller 120 according to an embodiment of the inventive concept.

According to the embodiment, the display controller 120 transfers display data in sub block-based units. A sub block may be defined by various rules according to embodiments. According to an embodiment, like the data stream 602 of FIG. 6, the display controller 120 groups a predetermined number of updated slices to define a sub block, repeats this to form several sub blocks, and transfers pixel data of each sub block to the display driver 310*a* at a scan order.

According to an embodiment, like the data stream 604, the display controller 120 configures a first updated slice (slice 1) as a sub block and groups next updated slices (slices 2 and 3) in a predetermined number of slices to define sub blocks. According to an exemplary embodiment, like the data stream 606, the display controller 120 groups the spatially adjacent updated slices 2 and 3 into one sub block.

According to an exemplary embodiment, like the data stream 608, the display controller 120 transfers the display data in slice-based units to the display driver 310*a*. According to an exemplary embodiment, the display controller 120 generates a data stream including information about a slice position and frame data of a slice for each slice-based unit and sequentially transfer the data stream to the display driver 310*a* at a slice-based order. The display controller 120 may determine the order of slices at a raster scan order when generating the data stream. Also, the display driver 310*a* may transfer pixel data at a raster scan order with respect to each slice. For example, when the display controller 120 transfers display data to the display driver 310*a*, the display controller 120 transfers information about a position of the slice 1 with respect to the slice and then transfers pixel data at a raster scan order, transfers information about a position of the slice 2 with respect to the slice 2, and then transfers the pixel data at a raster scan order. Transfer of the display data in slice-based units may be performed on all updated slices.

Figure 7:
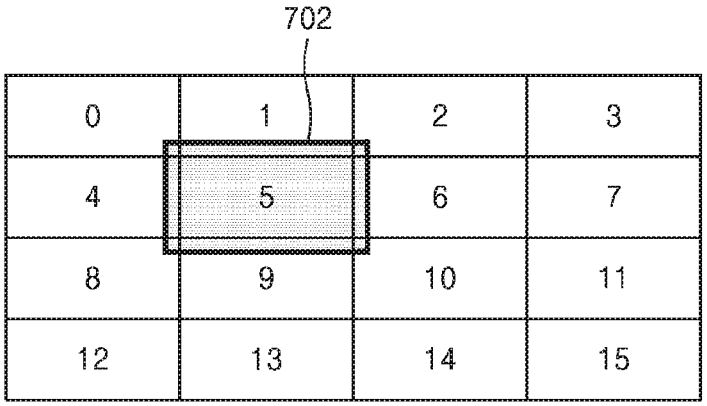
FIG. 7 is a diagram for describing an operation in which a display controller fetches an updated slice, according to an exemplary embodiment of the inventive concept.

FIG. 7 is a diagram for describing an operation in which the display controller 120 fetches an updated slice according to an exemplary embodiment of the inventive concept.

When an image enhancer of the display controller 120 calculates local information (for example, a luminance mean value) of each partition and then the local information is used when the image enhancer processes a next frame in order to support partial window update, the image enhancer may need spatial position information and need to calculate a local means for corresponding partitions. If a partition of the image enhancer cannot be aligned with a slice boundary, the calculation of the image enhancer may require a complex arithmetic calculation. To support multiple partial updates, a descriptor queue element (DQE) engine needs to process local mean information without any software intervention and an algorithm needs to be changed to align a partition boundary of the image enhancer with the slice boundary for hardware implementation. According to an embodiment, when the display controller 120 fetches frame data from the DRAM 338, the display controller 120 fetches additional surrounding pixels as well as pixel data of an updated slice for image enhancement processing. For example, when a slice 5 is an updated slice, the display controller 120 fetches pixel data corresponding to a partition 702 of the image enhancer including the slice 5 from the DRAM 338. In the example shown in FIG. 7, the surrounding pixels are located in adjacent slices 0, 1, 2, 4, 6, 8, 9, and 10.

If a tap filter is used in a pixel processor to change resolution of a source image, the display controller 120 according to an embodiment fetches additional surrounding pixels as well as pixel data of an updated slice for tap filtering when fetching the frame data from the DRAM 338. For example, to update the slice 5, pixels of the region 702 are required for tap filtering. In this case, based on a slice update map, a scale ratio, a scaler phase, overlapping for tap filtering, and border information of a current slice, a DMA of the display controller 120 may calculate a start address and a required number of pixels for the current slice and fetch pixel data from DRAM 338 according to a calculation result.

Figure 8A:
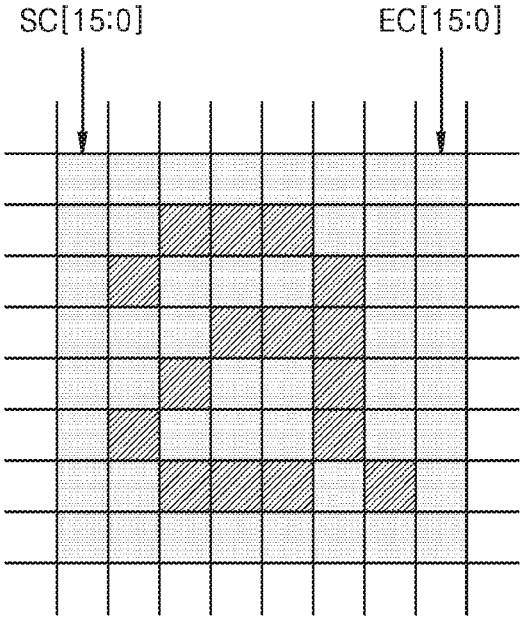
FIGS. 8A and 8B illustrate information about a sub block.
Figure 8B:
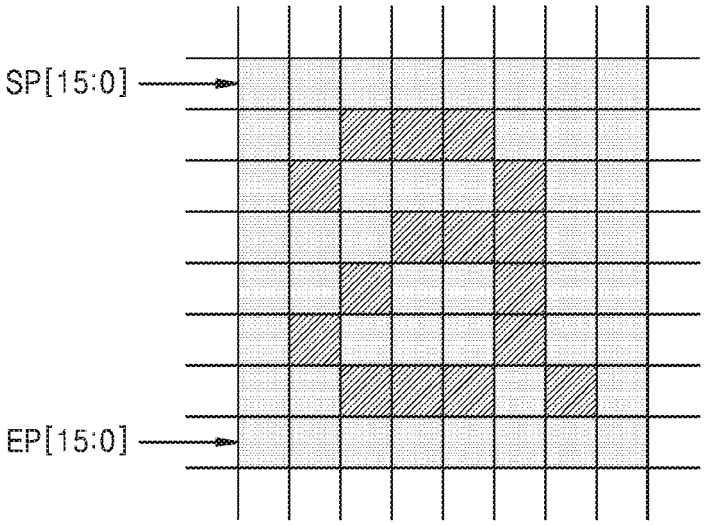

FIGS. 8A and 8B illustrate information about a sub block.

According to an embodiment, the information about the sub block includes a position of a start point and a position of an end point of the sub block.

When video data is transferred through a DSIM in compliance with MIPI DCS, the following command sets may be used. According to an embodiment, the DSIM writes a column address of the start point of the sub block and a column address of the end point of the sub block to a CASET region of a data stream having a MIPI DCS format. For example, as shown in FIG. 8A, SC[15:0] that is the column address of the start point of the sub block and EC[15:0] that is the column address of the end point of the sub block may be written to the CASET region. Also, the DSIM may write a page address of the start point of the sub block and a page address of the end point of the sub block to a PASET region of MIPI DCS. A page means a row orthogonal to a column. For example, as shown in FIG. 8B, SP[15:0] that is the page address of the start point of the sub block and EP[15:0] that is the page address of the end point of the sub block may be written to the PASET region of the data stream.

Figure 9:
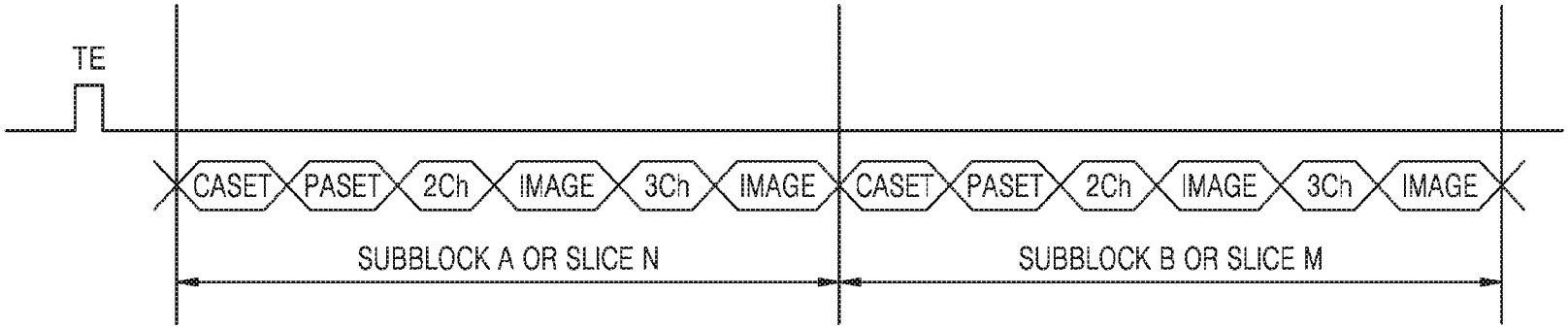
FIG. 9 illustrates a structure of a data stream transferred from a display controller to a display driver, according to an exemplary embodiment of the inventive concept.

FIG. 9 illustrates a structure of a data stream transferred from the display controller 120 to a display driver according to an exemplary embodiment of the inventive concept.

According to an embodiment, the display controller 120 generates a data stream in a MIPI DCS format, as shown in FIG. 9. The MIPI DCS format is one of the widely used schemes when an electronic device and a display device transfer a data stream. Thus, the present embodiment has an advantage of excellent compatibility with conventional electronic devices and display devices.

The MIPI DCS format is a serial transfer scheme in which CASET, PASET, 2Ch, Image, 3Ch, and Image regions are sequentially arranged as shown in FIG. 9. According to an embodiment, the display controller 120 writes information about a sub block or a slice to the CASET and PASET regions and writes display data corresponding to the sub block or the slice to the Image regions.

When the display data is transferred in sub block-based units, the data stream in the MIPI DSC form is sequentially transferred in sub block-based units (SUBBLOCK A, SUBBLOCK B) by serial transmission. When the display data is transferred in slice-based units, the data stream in the MIPI DSC format is sequentially transferred in slice-based units (SLICE N, SLICE M) by serial transmission.

As described with reference to FIGS. 8A and 8B above, when the display data is transferred in sub block-based units, a column address of a start point of a sub block and a column address of an end point of the sub block is written to the CASET regions and a page address of the start point of the sub block and a page address of the end point of the sub block is written to the PASET regions. When the display data is transferred in slice-based units, a column address of a start point of a slice and a column address of an end point of the slice is written to the CASET regions and a page address of the start point of the slice and a page address of the end point of the slice is written to the PASET regions.

In an embodiment, GRAM write commands are written to the 2Ch and 3Ch regions. A command write_memory_start to write the display data in GRAM may be written at a pixel position specified by the preceding CASET and PASET regions in the 2Ch regions. A command write_memory_continue to write the display data in the GRAM may be written from a pixel position following the previous command write_memory_start or the command write_memory_start in the 3Ch regions. A DPHY of the display driver may write data of the Image regions following the 2Ch regions at positions specified by the CASET and PASET regions and write data of the Image regions following the 3Ch regions from pixel positions following regions specified by the preceding CASET and PASET regions. According to an embodiment, multiple partial windows are supported in compliance with MIPI DCS.

However, a current DSIM has a limitation in sending CASET, PASET, 2Ch, and 3Ch commands. The current DSIM may send these commands only after an end of a DSIM frame is asserted. The DSIM according to an exemplary embodiment of the inventive concept interleaves CASET, PASET, and data in slice-based units and, when each slice data is transferred from a DECON by using a slice_update_map (SFR) and slice resolution information (PPS: picture parameter set), automatically sends the CASET, PASET and data through a PHY.

According to an embodiment, as shown in FIG. 9, every time a frame starts, a TE signal is inserted. For example, when a series of sub blocks or slices is transferred during a second time period, a TE signal may be transferred during a first time period that precedes the second time period. When the display driver processes video data in a raster scan order and the display controller 120 sends data at a slice-based order, a certain part of slice data may be transferred later or earlier than an expected time. As such, a symptom where different pieces of time frame data are displayed at the same time frame is referred to a tearing problem. Since the display driver exploits a single buffer scheme, when a data write from an electronic device to a GRAM is later or earlier than an expected time, the tearing problem may occur.

Figure 10A:
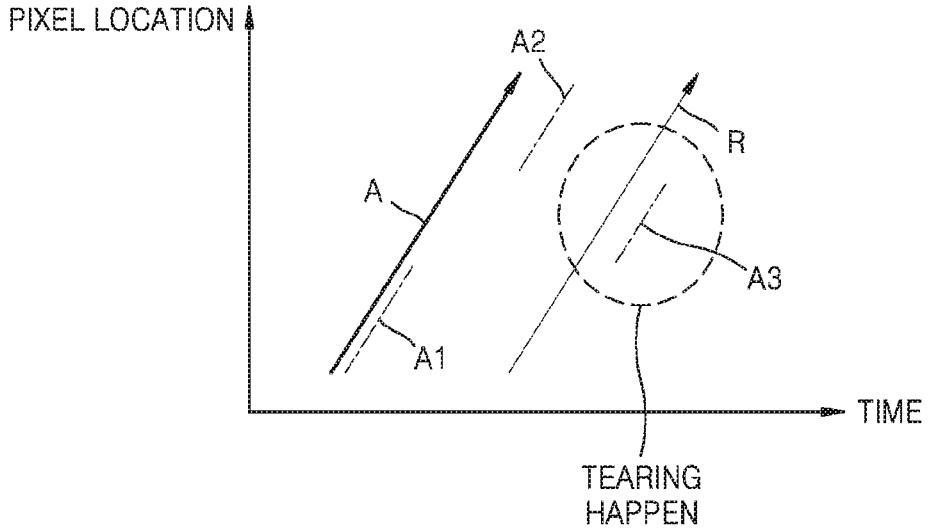
FIGS. 10A and 10B are diagrams for describing a method of preventing a tearing problem, according to an exemplary embodiment of the inventive concept.
Figure 10B:
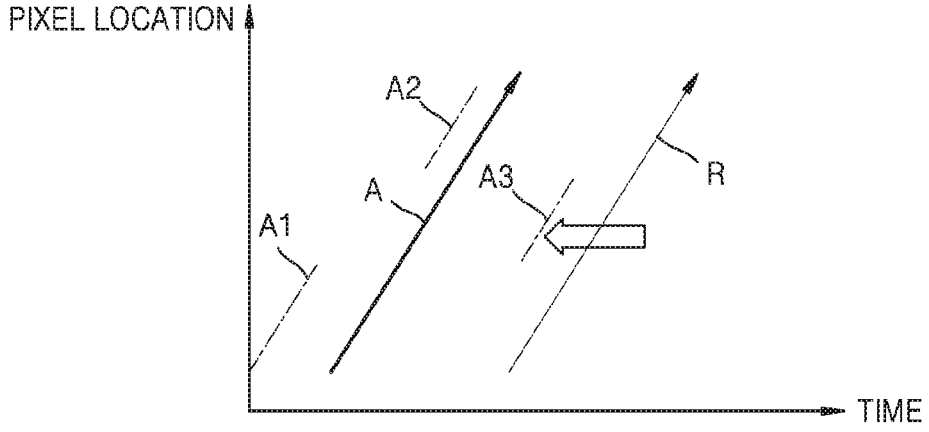

FIGS. 10A and 10B are diagrams for describing a method of preventing a tearing problem, according to an exemplary embodiment of the inventive concept.

In FIGS. 10A and 10B, A denotes a write curve indicating an operation of a display driver that writes data to a GRAM when a slice update map is not used, A1, A2, and A3 are write curves indicating an operation of the display driver that writes data to the GRAM when transferring display data of an updated slice in sub block-based units or slice-based units by using the slice update map, and R denotes a display curve indicating an operation of displaying the display data on a display panel. When the slice update map is not used, since display data for each pixel is written like the curve A at a raster scan order, no tearing problem occurs. However, when the slice update map is used, due to an arrangement of an updated slice, as shown in FIG. 10A, display data of a corresponding position is not updated in time when display data is displayed on the display panel (the curve A3). According to an exemplary embodiment, as shown in FIG. 10B, the display controller 120 inserts a TE signal every time a frame starts and advances a TE signaling time by a slice height, thereby preventing a tearing problem from occurring due to slice data transferred later than an expected time. Referring to FIG. 10B, by advancing the TE signaling time, write timing of the display data may be advanced by the slice height, and thus no tearing problem occurs. A time length by which the TE signaling time is advanced may be variously determined according to embodiments of the inventive concept.

Figure 11A:
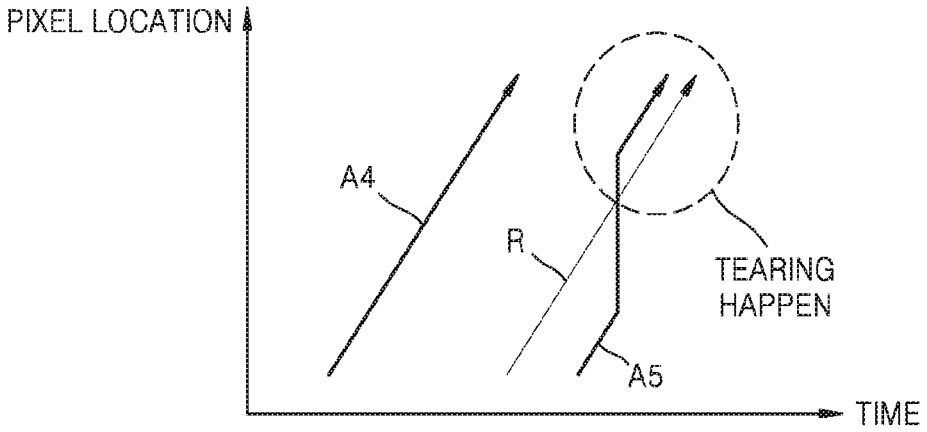
FIGS. 11A and 11B are diagrams for describing a method of preventing a tearing problem, according to an exemplary embodiment of the inventive concept.
Figure 11B:
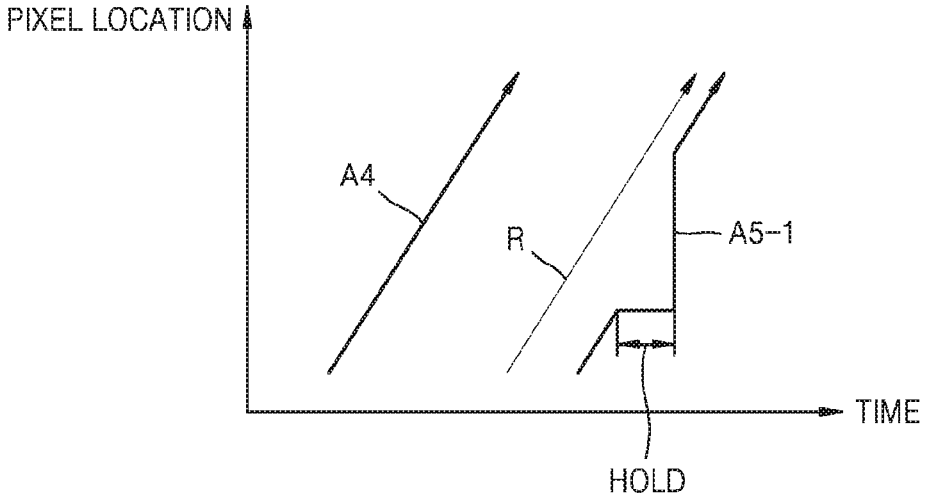

FIGS. 11A and 11B are diagrams for describing a method of preventing a tearing problem, according to an exemplary embodiment of the inventive concept.

In FIGS. 11A and 11B, A4, A5, and A5-1 denote write curves indicating an operation of writing data to a GRAM when display data of an updated slice is transferred in sub block-based units or a slice-based units, and R denotes a display curve indicating an operation of displaying the display data on a display panel. The write curve A4 relates to an nth frame. The write curves A5 and A5-1 relate to an n+1th frame. The display curve R relates to the nth frame.

When the display data is written to the GRAM earlier than an expected time and a write curve pulls in a display curve, a tearing problem may occur. For example, as shown in FIG. 11A, when the curve A5 that is the write curve of the n+1th frame pulls in the display curve R of the nth frame, the tearing problem may occur. For example, when the TE signaling time is advanced and a partial window having a lowermost slice is transferred, the tearing problem may occur. In this case, before finishing display of a current frame, partial window data of a next frame may be written to the GRAM. To prevent this kind of tearing, in an exemplary embodiment, the DSC decoder 314 of the display driver 310*a* controls output timing so that slices are not sent earlier than an expected time. For example, as shown in FIG. 11B, the display controller 120 may include a timer to check timing and output display data to the display driver 310*a* earlier than an expected time, the display controller 120 may hold transfer of the display data and output the display data to the display driver 310*a* at the expected time.

Figure 12A:
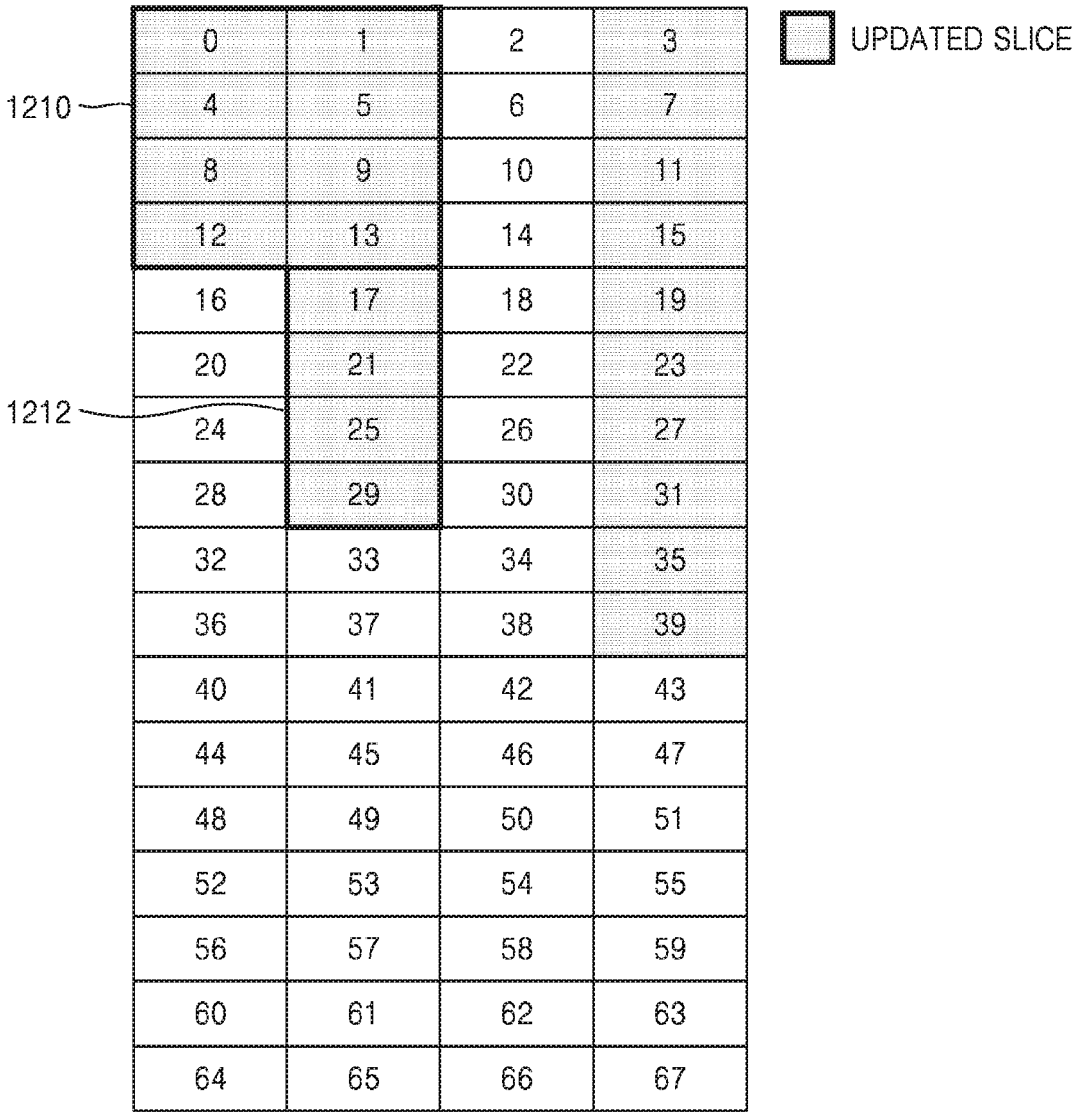

FIGS. 12A and 12B are diagrams for describing a scheme of defining sub blocks 1210, 1212, 1220, and 1222 according to an exemplary embodiment of the inventive concept.

According to an embodiment, the display controller 120 defines the sub blocks 1210, 1212, 1220, and 1222 to have a horizontal width as long as possible to prevent a tearing problem. An updated slice arrangement as shown in FIGS. 12A and 12B will now be described. The display controller 120, as shown in FIG. 12A, sets the sub block 1210 including slices 0, 1, 4, 5, 8, 9, 12, and 13 and the sub block 1212 including slices 17, 21, 25, and 29. As another example, the display controller 120, as shown in FIG. 12B, sets the sub block 1220 including slices 0, 4, 8, and 12 and the sub block 1222 including slices 1, 5, 9, 13, 17, 21, 25, and 29. However, when a display panel is updated at raster scan scheme, since pixels in an upper side of a frame are firstly updated, if the pixels in the upper side are firstly transferred when an updated slice is transferred to a display driver, a tearing problem may be prevented. When the display panel is updated using a raster scan scheme, the display controller 120 according to an embodiment sets widths of sub blocks as wide as possible such that firstly accessed pixels are firstly transferred to the display driver, thereby preventing the tearing problem.

Figure 13A:
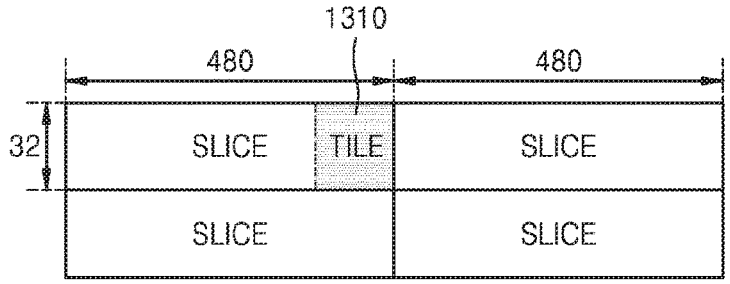
FIGS. 13A and 13B are diagrams for describing a scheme of setting slices according to an exemplary embodiment of the inventive concept.
Figure 13B:
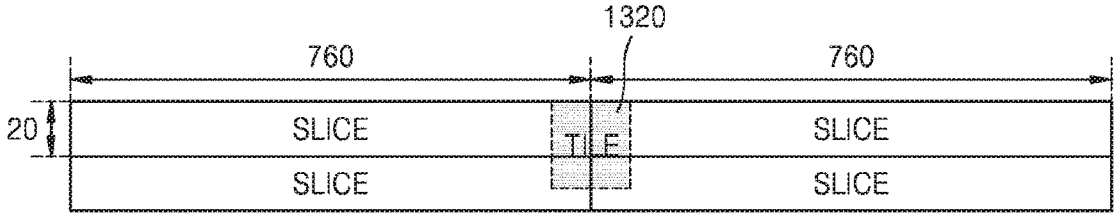

FIGS. 13A and 13B are diagrams for describing a scheme of setting slices according to an exemplary embodiment of the inventive concept.

According to an embodiment, the processor 110 aligns DSC slices with a GPU update unit. Also, the processor 110 sets slices so as to reduce the number of updated slices. As shown in FIG. 13A, when an updated tile 1310 having a data change is arranged in a slice, since one slice is updated, the display controller 120 needs to process only display data of the one slice and transfer the processed display data to a display driver. As another example, as shown in FIG. 13B, when an updated tile 1320 having a data change is arranged over four slices, even if a size of the updated tile 1302 is similar to that of the updated tile 1310 of FIG. 13A, the display controller 120 may need to process display data of the four updated slices and transfer the processed display data to the displayer driver. According to an embodiment, the processor 110 defines slices so as to reduce the number of updated slices based on a location and an area of an updated tile. For example, the processor 110 may define slices as shown in FIG. 13A, rather than slices as shown in FIG. 13B.

Also, according to an exemplary embodiment, when the processor 110 defines slices, the processor 110 sets small size slices in order to reduce the size of updated slices. For example, the processor 110 may set slices by minimizing the number of pixels of each slice in order to satisfy 15000 pixels per slice defined by certain standards.

Figure 14:
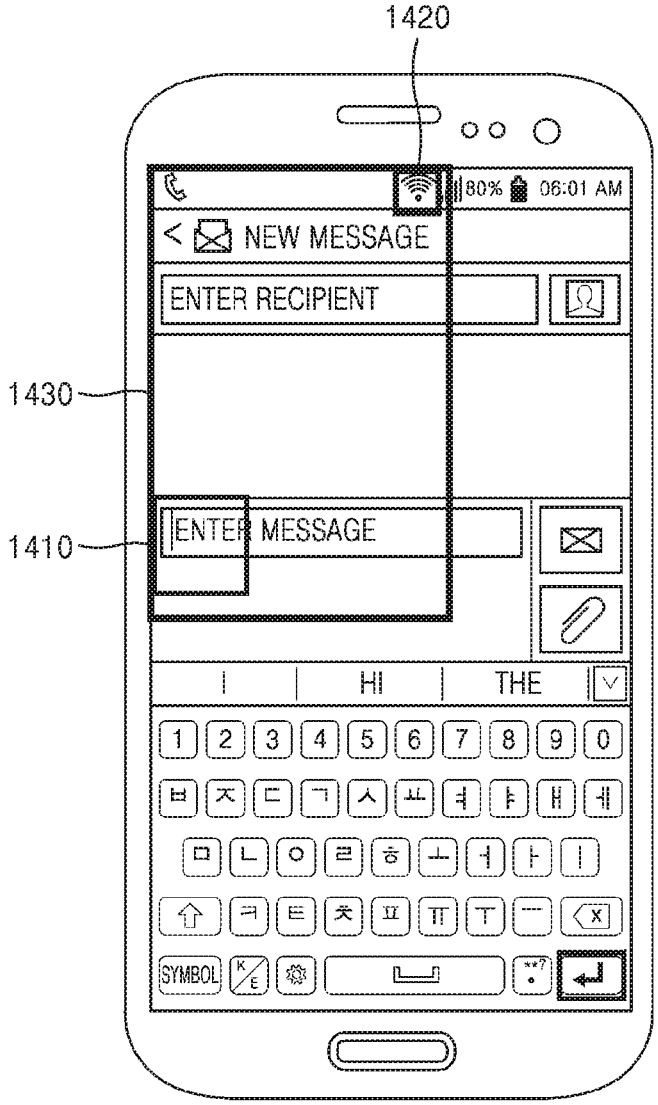
FIG. 14 illustrates a graphical user interface (GUI) screen according to an exemplary embodiment of the inventive concept.

FIG. 14 illustrates a GUI screen according to an exemplary embodiment of the inventive concept.

FIG. 14 shows a screenshot of a multimedia messaging service (MMS) application. If a scheme of defining one box including all updated regions and updating frame data in the one box is used, when a user types characters to a message window, even though only a region 1420 partially different from a region 1410 is updated, a rectangular area 1430 including all updated regions of a frame needs to be updated. The rectangular area 1430 may be set excessively larger than the region 1410 due to the partially different and updated region 1420. According to an exemplary embodiment of the inventive concept, data stream transfer is individually processed with respect to the partial updated regions 1410 and 1420 by using a multiple partial update scheme. By using such a scheme, unnecessary data transfer for a non-updated region may be reduced, and thus power consumption may be dramatically reduced.

Figure 15:
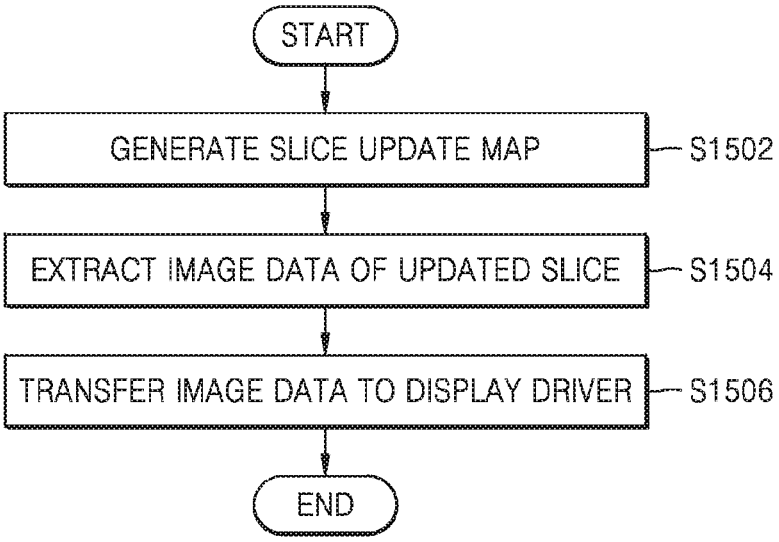
FIG. 15 is a flowchart of an electronic device control method according to an exemplary embodiment of the inventive concept.

FIG. 15 is a flowchart of an electronic device control method according to an exemplary embodiment of the inventive concept.

The electronic device control method according to embodiments may be performed by various electronic devices including a processor and a memory. An embodiment in which an electronic device according to the embodiments of FIGS. 1 and 3 performs the electronic device control method is described but embodiments of the inventive concept are not limited thereto. Also, the embodiments of the electronic device described with reference to FIGS. 1 through 14 may apply to electronic device control methods and embodiments of the electronic device control methods may apply to the embodiments of the electronic device.

The electronic device generates a slice update map indicating a location of at least one updated slice having a data change in frame data including a plurality of slices (operation S1502). The electronic device may generate information about a height and a width of each slice of the slice update map.

The electronic device extracts frame data of the at least one updated slice from the memory that stores the frame data based on the slice update map (operation S1504). The electronic device may determine a memory access address and extract the frame data corresponding to the updated slice based on the slice update map.

The electronic device transfers the extracted frame data of the updated slice to a display driver (operation S1506). According to an embodiment, the electronic device performs image processing on the extracted frame data to generate processed data, generates a data stream for serial transmission using the processed data, and transfers the generated data stream to the display driver. The data stream transferred to the display driver may be generated in a MIPI DCS form. Also, the data stream may be transferred in sub block-based units or slice-based units by serial transmission.

Figure 16:
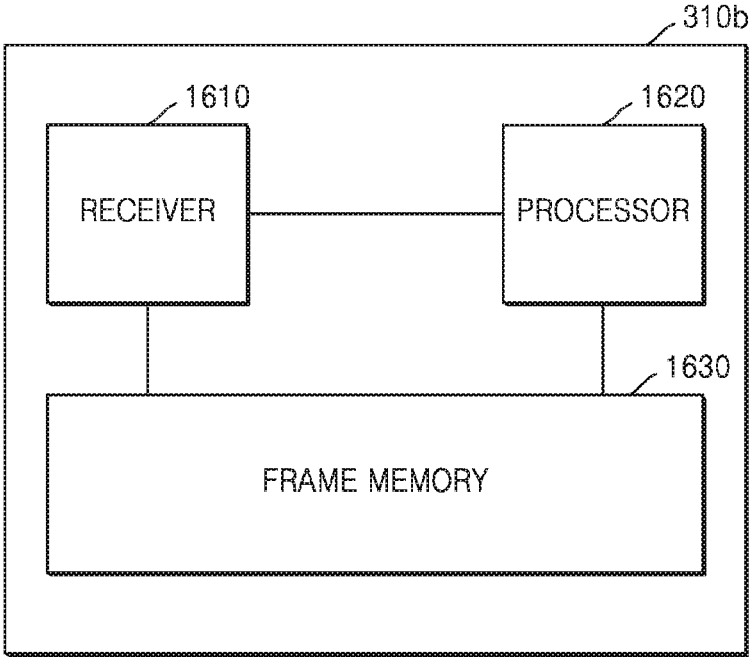
FIG. 16 is a bock diagram of a structure of a display driving device according to an exemplary embodiment of the inventive concept.

FIG. 16 is a bock diagram of a structure of a display driving device 310*b* according to an exemplary embodiment of the inventive concept.

The display driving device 310*b* according to an embodiment is integrally included in the electronic device 100*b*. According to an embodiment, the display driving device 310*b*, along with a display panel, is included in a display device separate from an electronic device. The display driving device 310*b* may be referred to a DDI and may provide display data to the display panel and drive the display panel. In FIG. 16, embodiments in which the display driving device 310*b* is connected to the electronic device 100*a* of FIG. 1 is described but embodiments of the inventive concept are not limited thereto.

The display driving device 310*b* according to an embodiment includes a receiver 1610, a processor 1620, and a frame memory 1630. In an embodiment, the receiver is implemented within transceiver hardware capable of wirelessly receiving data using one or more wireless communication protocols.

The receiver 1610 may receive a data stream transferring display data from the electronic device 100*a*. According to an embodiment, the receiver 1610 receives the data stream in a sub block-based units or a slice-based units by serial transmission.

According to an embodiment, the receiver 1610 may receive a MIPI DCS data steam. The receiver 1610 may be, for example, a DPHY according to the MIPI alliance as shown in FIG. 3. According to the present embodiment, the receiver 1610 may execute commands written to 2Ch and 3Ch regions according to addresses defined in CASET and PASET of the MIPI DCS data stream and update display data stored in the frame memory 1630.

According to an embodiment, the receiver 1610 receives display data of updated sub blocks in sub block-based units and information about locations of start points and end points of the sub blocks. Also, the receiver 1610 may use the information about the locations of the start points and the end points of the sub blocks to access addresses in memory corresponding to the locations of the sub blocks and update the display data.

The frame memory 1630 may store the display data. According to an embodiment, the frame memory 1630 stores display data of one frame. Thus, if the display data is written to the frame memory 1630 earlier or later than an expected time, a tearing problem may occur. The frame memory 1630 may be implemented in the GRAM as shown in FIG. 3. According to an embodiment, the frame memory 1630 stores the display data encoded according to the DSC standards.

The processor 1620 may control general operations of the display driving device 310*b*. In an embodiment, the processor 1620 is configured to output the one frame stored in the frame memory 1630 to a display panel. In an embodiment, the processor 1620 is configured to delay update by the receiver 1610 of the frame memory 1630 when a certain condition occurs. For example, the processor 1620 can send a signal to the receiver 1610 set at a first level indicating it is currently outputting the frame to the display panel, and set at a second level indicating it is not currently outputting the frame. For example, the receiver 1610 can delay its update until the signal is set to the second level. According to an embodiment, the display driving device 310*b* decodes the display data encoded according to the DSC standards and outputs the display data to the display panel.

Figure 17:
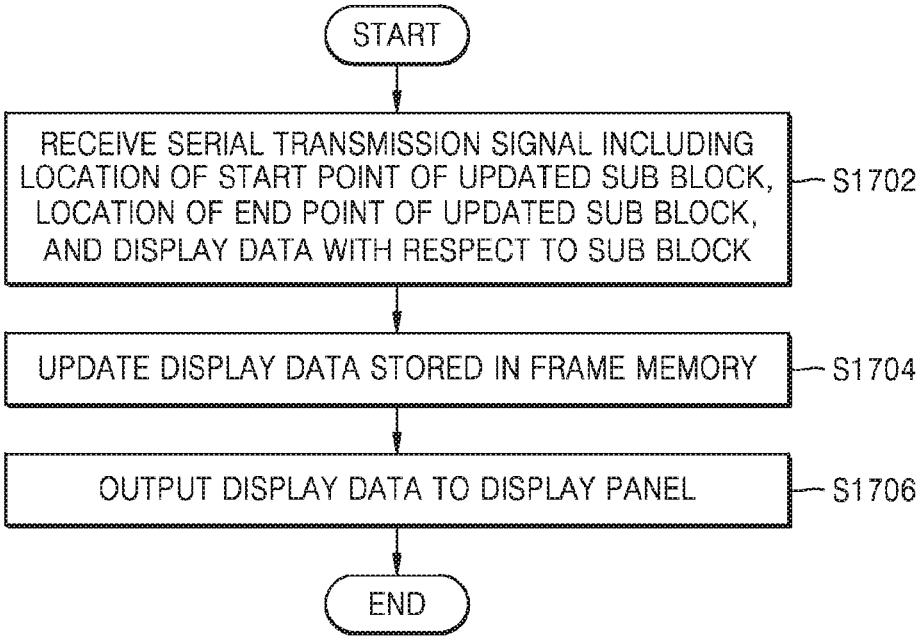
FIG. 17 is a flowchart of a display driving method according to an exemplary embodiment of the inventive concept.

FIG. 17 is a flowchart of a display driving method according to an exemplary embodiment of the inventive concept.

The display driving method according to embodiments may be performed by various electronic devices including a processor and a memory. An embodiment in which a display driver or a display driving device according to the embodiments of FIGS. 3 and 6 performs the display driving method is described but embodiments of the inventive concept are not limited thereto. Also, the embodiments of a display driver or a display driving device described with reference to FIGS. 1 through 16 may apply to display driving methods and embodiments of the display driving methods may apply to the embodiments of the display driver or the display driving device.

The display driving device receives a serial transmission signal including a location of a start point of an updated sub block, a location of an end point of the updated sub block, and display data with respect to at least one sub block having a data change (operation S1702). As described above, the serial transmission signal may be transferred in sub block-based units by serial transmission and may be a MIPI DCS data stream.

The display driving device updates display data stored in a frame memory by using the received display data with respect to the at least one sub block (operation S1704). The display driving device updates the display data of the updated sub block stored in the frame memory by using information about the location of the start point of the updated sub block and the location of the end point of the updated sub block.

The display driving device outputs the display data stored in the frame memory to a display panel (operation S1706). According to an embodiment, the display driving device stores the display data encoded according to the DSC standards in the frame memory, decodes the display data according to a certain timing, and outputs the display data to the display panel.

While the inventive concept has been particularly shown and described with reference to embodiments thereof, it will be understood that various changes in form and details may be made therein without departing from the spirit and scope of the inventive concept.

What is claimed is:

1. An electronic device comprising:

a processor configured to determine tiles of frame data whose data has been updated, divide the frame data into a first number of first slices to update and a second number of second slices to exclude from the update according to a size and a location of the tiles to minimize the first number of the first slices to update, and generate a slice update map indicating a location of the first slices, where the minimization results in each tile whose data has been updated being included within a least number of the first slices to update; and a display controller configured to extract frame data of the first slices from a memory based on the slice update map by grouping the first slices spatially adjacent one another in a frame into at least one least one sub block, and wherein the display controller is further configured to transfer the frame data to a display driver by transferring the at least one sub block in sub block based units to the display driver, wherein each tile is smaller than each slice.

2. The electronic device of claim 1, wherein the processor outputs the slice update map and information about a slice width and a slice height of a slice among the first slices to the display controller.

3. The electronic device of claim 1, wherein the display controller performs at least one of color coordinate conversion, enhancement processing, and blending on the frame data of the first slices based on the slice update map.

4. The electronic device of claim 1, wherein each sub block comprises a location of the corresponding sub block within the frame data and display data of the corresponding sub block, and wherein each sub block is defined to have a rectangular shape comprising at least one of the first slices.

5. The electronic device of claim 4, wherein the display controller transfers the sub block-based units to the display driver by serial transmission.

6. The electronic device of claim 1, wherein each sub block comprises a location of a start point of the corresponding sub block, a location of an end point of the corresponding sub block, and display data of the corresponding sub block.

7. The electronic device of claim 1, wherein the display controller transfers information about a slice width and a slice height of each of the first slices to the display driver, and transfers information about a slice location of each of the first slices and display data to the display driver in slice-based units.

8. The electronic device of claim 1, wherein the display controller transfers a TE signal informing of a start of the frame data to the display driver.

9. The electronic device of claim 8, wherein the display controller transfers the TE signal to the display driver in advance of transfer of the frame data.

10. The electronic device of claim 1, wherein the display controller holds transfer of display data when a transfer time of display data of the first slices is earlier than an expected time.

11. The electronic device of claim 1, wherein each of the at least one sub block is defined to have a horizontal length as long as possible.

12. The electronic device of claim 1, wherein the display driver comprises a frame memory that stores display data in a frame-based unit.

13. The electronic device of claim 1, wherein the display controller transfers the sub block-based units comprising display data to the display driver according to a mobile industry processor interface (MIPI) alliance standard.

14. An electronic device control method comprising:

determining, by a processor, tiles of frame data whose data has been updated;

dividing, by the processor, the frame data into a first number of first slices to update and a second number of second slices to exclude from the update according to a size and a location of the tiles to minimize the first number of the first slices to update;

generating, by the processor, a slice update map indicating a location of the first slices, where the minimization results in each tile whose data has been updated being included within a least number of the first slices to update;

extracting, by a display controller, frame data of the first slices from a memory based on the slice update map by grouping the first slices spatially adjacent one another in a frame into at least one least one sub block; and transferring, by the display controller, the frame data to a display driver by transferring the at least one sub block in sub block based units to the display driver according to their raster scan order on a display device, wherein each tile is smaller than each slice.

15. The electronic device control method of claim 14, further comprising:

the processor outputting the slice update map and information about a slice width and a slice height of a slice among the first slices to the display controller.

16. The electronic device control method of claim 14, further comprising:

the display controller performing at least one of color coordinate conversion, enhancement processing, and blending on the frame data of the first slices based on the slice update map.

17. The electronic device control method of claim 14, wherein each sub block comprises a location of the corresponding sub block within the frame data and display data of the corresponding sub block within the frame data, and wherein each sub block is defined to have a rectangular shape comprising at least one of the first slices.

* * * * *